US006116836A

United States Patent [19]

Long, Sr.

[11] Patent Number: 6,116,836

[45] Date of Patent: Sep. 12, 2000

[54] CONNECTOR FOR COMPOSITE INSULATED WALL AND METHOD FOR MAKING THE WALL

[75] Inventor: Robert T. Long, Sr., Ames, Iowa

[73] Assignee: Composite Technologies Corporation, Ames, Iowa

[21] Appl. No.: 08/901,587

[22] Filed: Jul. 28, 1997

Related U.S. Application Data

[63] Continuation-in-part of application No. 08/615,638, Mar. 13, 1996, Pat. No. 5,671,574, which is a continuation of application No. 08/255,528, Jul. 26, 1994.

[51] Int. Cl.[7] ..... F04B 1/38; F16B 15/00; F16B 35/00

[52] U.S. Cl. ..... 411/451.1; 411/424; 411/480; 411/482; 411/488; 411/490; 411/496; 52/410; 52/700

[58] Field of Search ..... 411/446, 451, 411/480, 482, 488, 489, 490, 496, 411, 424, 451.1; 52/404.2, 410, 698, 700

[56] References Cited

U.S. PATENT DOCUMENTS

| | | | |
|---|---|---|---|
| 2,182 | 7/1841 | Ballard | 411/451 |
| 1,906,527 | 5/1933 | Bradley | 411/451 |
| 1,958,049 | 5/1934 | Kleitz . | |
| 2,412,744 | 12/1946 | Nelson . | |
| 2,645,929 | 7/1953 | Jones . | |
| 2,653,469 | 9/1953 | Callan . | |
| 2,775,018 | 12/1956 | McLaughlin . | |
| 3,274,680 | 9/1966 | Cruse . | |
| 3,426,494 | 2/1969 | Hala . | |
| 3,750,355 | 8/1973 | Blum . | |
| 3,927,857 | 12/1975 | Lovisa et al. . | |
| 3,965,635 | 6/1976 | Renkert . | |
| 4,018,023 | 4/1977 | Anderson | 52/410 |
| 4,052,831 | 10/1977 | Roberts et al. . | |
| 4,109,436 | 8/1978 | Berloty . | |
| 4,283,896 | 8/1981 | Fricker et al. . | |
| 4,329,821 | 5/1982 | Long et al. . | |
| 4,348,847 | 9/1982 | Jukes . | |
| 4,370,840 | 2/1983 | Bisbee et al. | 52/410 |
| 4,393,635 | 7/1983 | Long . | |
| 4,489,530 | 12/1984 | Chang . | |
| 4,545,163 | 10/1985 | Asselin . | |
| 4,624,089 | 11/1986 | Dunker . | |
| 4,702,053 | 10/1987 | Hibbard . | |
| 4,829,733 | 5/1989 | Long . | |
| 4,974,381 | 12/1990 | Marks . | |
| 5,011,354 | 4/1991 | Brownlee | 411/451 |
| 5,519,973 | 5/1996 | Keith et al. . | |
| 5,557,898 | 9/1996 | Dixon | 52/410 |
| 5,588,788 | 12/1996 | Dominguez | 411/482 |
| 5,606,832 | 3/1997 | Keith et al. | 52/309.11 X |
| 5,671,574 | 9/1997 | Long . | |
| 5,673,525 | 10/1997 | Keith et al. | 52/309.11 |

*Primary Examiner*—Robert Canfield
*Attorney, Agent, or Firm*—Zarley, McKee, Thomte, Voorhees & Sease

[57] ABSTRACT

An insulated wall includes first and second spaced apart layers of concrete having a layer of insulating material sandwiched therebetween. Extending through the insulative layer are a plurality of spike connectors having their opposite ends protruding into the two concrete layers and having their central portions extending through the insulating material. On of the opposite ends of the spike connectors is pointed so as to permit it to be punched through the insulative layer. The opposite ends of the spikes each include a holding surface facing at least partially toward the central insulative layer and holding the concrete layers against movement away from the insulative layer. C-shaped connectors may also be used in a similar fashion with hook ends hooked over elongated cables extending within the two concrete layers so as to tie them together.

13 Claims, 7 Drawing Sheets

CONNECTOR FOR COMPOSITE INSULATED WALL AND METHOD FOR MAKING THE WALL

CROSS-REFERENCE TO A RELATED APPLICATION

This application is a Continuation-in-part application based on Ser. No. 08/615,638 filed Mar. 13, 1996 now U.S. Pat. No. 5,671,574 which was a continuation of Ser. No. 08/255,528 filed Jul. 26, 1994.

BACKGROUND OF THE INVENTION

This invention relates to a connector for a composite insulated wall and method for making the wall.

Insulated walls have been constructed in the prior art utilizing first and second concrete layers having an insulated layer sandwiched therebetween. Connectors or ties have been provided for extending through the concrete layers and the central insulating layer to connect them together. One type of connector has been made of metal or other material which is a high conductor of heat. When this type of connector is used, it forms a conduit for the passage of heat from one side of the wall to the other, and substantially reduces the effective R-value (low thermal conductivity) of the wall.

Fiber composite connectors having a high R-value have been used as shown in U.S. Pat. No. 4,829,733. The connector shown in this patent utilizes an elongated member having blunt opposite ends. The insulation layer is provided with holes for receiving the connector so that the connector can be passed through the insulating layer with its opposite ends embedded in the two concrete layers. Absent holes in the insulation layer, the plunging of connectors through the insulation material breaks up pieces of the insulation material and pushes such broken pieces into the uncured concrete, thus inhibiting or impairing proper consolidation of the concrete layer. The insulation break up also creates vapor leaks and loss of insulating R-value.

Therefore, a primary objective of the present invention is to provide an improved connector for a composite insulated wall and an improved method for making the wall.

A further object of the present invention is the provision of an improved composite insulated wall utilizing a pointed plastic connector which can be forced through the insulative layer without requiring the formation of holes in the insulative layer.

A further object of the present invention is the provision of hook shaped plastic connectors having a high R-value, for connecting elongated reinforcing rods or strands extending through the concrete layers on opposite sides of the insulating layer.

A further object of the present invention is the provision of composite panels which do not bow or crack in response to temperature changes.

A further object of the present invention is the provision of a composite insulated wall and method for making same which involves simple construction techniques, and which is efficient in operation.

SUMMARY OF THE INVENTION

The foregoing objects are achieved by an insulated wall having first and second spaced apart layers of concrete with a layer of insulating material sandwiched therebetween. A plurality of elongated shear connectors made of plastic or other high R material extend through the layer of insulating material so that their opposite ends protrude into the layers of concrete. Each connector includes a central body portion and opposite end portions. The opposite end portions of the shear connectors each have a holding surface defined by segments of varying dimension which face at least partially towards the insulating layer and which engage the first and second layers of concrete respectively to hold the first and second concrete layers against movement away from the insulating material. One end portion of each of the shear connectors has a pointed tip which makes it possible to force the connector through the insulating material during construction.

In one embodiment, each of the central body portion and first and second end portions are substantially flat and all have substantially the same thickness. In a second embodiment, the tip on the first end portion includes rasps for boring through the insulation. In a third embodiment, the tip of the first in portion includes threads for threaded passage through the insulation layer. Threads may also be provided on the central body portion of the third embodiment.

The method for making the composite wall involves taking the above described shear connectors and forcing the pointed tips of the shear connectors through the layer of insulating material to a position wherein the first and second end portions of the connectors protrude outwardly from the opposite sides of the layer of insulation, and the central portion of the shear connectors are within the layer of insulation. The forcing of the connector through the insulation layer is by punching, boring or threaded screwing action for the first, second and third connector embodiments, respectively. Next the first layer of concrete is poured and the layer of insulation material is placed on top of the poured layer before the concrete cures and hardens. The first ends of the shear connectors are pressed downwardly into the first layer of concrete so that the insulative layer abuts against the concrete. Alternatively, the insulation material may be placed upon the first layer of concrete before the connectors are in place, and then the connectors are forced through the insulation layer and into the first concrete layer. Next a second layer of concrete is poured over the upper surface of the insulation material so as to embed the other ends of the connectors in the second layer of concrete. When completed, and when the concrete has hardened, the holding surfaces of the opposite end portions of the shear connectors will hold the first and second concrete layers against movement away from the layer of insulating material.

In some applications, elongated strands of steel or other reinforcing material are placed within the first and second concrete layers and extend parallel to one another and to the central insulating layer. A hook connector having a central portion and first and second opposite hook shaped ends can be inserted through the insulating layer with the hook ends being hooked over cables on opposite sides of the insulating layer. The hook connector can be C-shaped, or can be shaped into a loop, with a slot formed in one of the loop sides so as to permit the device to be hooked over the two cables or strands in the first and second layers.

DESCRIPTION OF THE PREFERRED EMBODIMENTS

Figure 1:
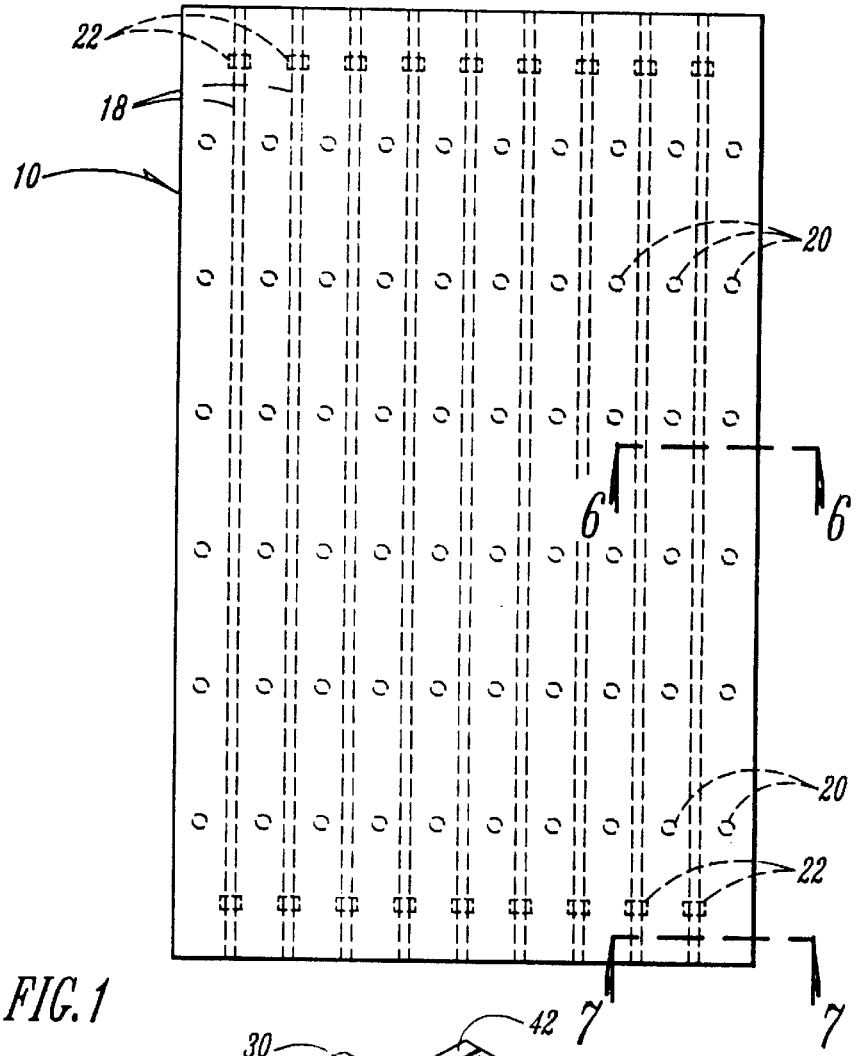
FIG. 1 is a plan view of an insulated wall made according to the present invention.

Referring to the drawings, the numeral 10 generally designates a composite wall made according to the present invention. Composite wall 10 includes a first concrete layer 12 and a second concrete layer 14 which have an insulating layer 16 sandwiched therebetween. The insulative layer 16 may be formed from insulation board commonly used in the construction industry. Its thickness may vary as desired, but preferably it is of a rigid shape so that it will hold its own shape. Extending along the vertical length of the concrete layers, are a plurality of elongated reinforcing members or stress strands 18 which are embedded in each of the two concrete layers 12, 14. These stress strands 18 are parallel to one another and are also parallel to the insulation board 16.

Extending through the insulation board 16 are a plurality of spike connectors 20 and C-shaped hook connectors 22. Alternatively, a plurality of loop shaped hook connectors 24 can be used in lieu of the C-shaped hook connectors 22.

Figure 5:
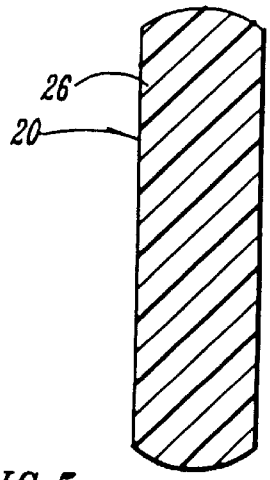
FIGS. 5 and 5*a* are sectional view taken along lines 5—5 and 5*a*—5*a* of FIG. 2.
Figure 5A:
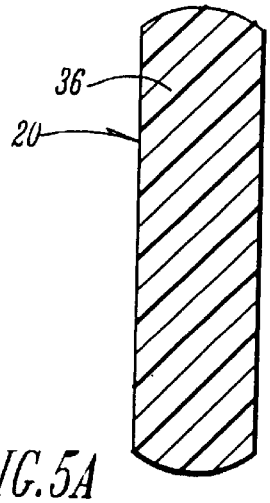

Each spike connector 20 includes a central portion 26, a pointed end portion 28, and a blunt end portion 30. The pointed end portion 28 includes a point 32 and a point taper 34 which tapers outwardly therefrom to a wide portion 36. As can be seen in FIGS. 5 and 5*a*, the cross-sectional size and shape of the wide portion 36 is approximately the same as the cross-sectional size and shape of the central portion 26. While the shape of these two portions is shown to be approximately rectangular, other shapes may be used without detracting from the invention.

A holding surface 38 is formed on the end portion 28 and faces at least partially toward the central portion 26 of the connector 20. The holding surface 38 is defined by the varying dimension of the end portion 28 from the wide portion 36 to the central portion 26. The holding surface 38 is shown in the drawings to be tapered, but it could also be perpendicular to the longitudinal axis of the spike connector 20. It is important, however, that the surface 38 face at least partially toward the central portion 26 so that it can engage concrete in one of the concrete layers 12, 14 and hold the concrete layer to the insulative layer as will be described hereafter. The blunt end portion 30 also includes a similar holding surface 40 defined by the varying dimension of the end portion 30 to the central portion 26. A flange 42 is attached to the spike connector and is positioned between the blunt end portion 30 and the central portion 26. While the flange 42 is preferred for use with the spike connector 20, it is possible to use spike connector 20 without having any flange 42 thereon.

Figure 3:
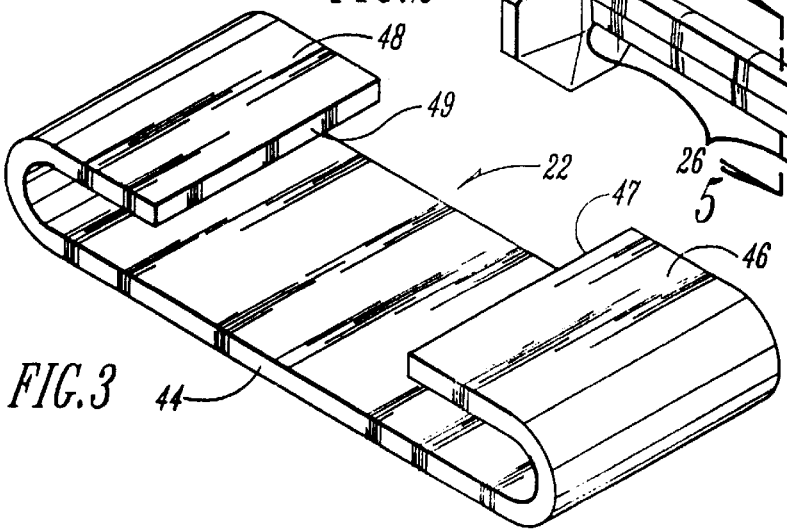
FIG. 3 is a perspective view of the C-shaped connector used in the present invention.
Figure 4:
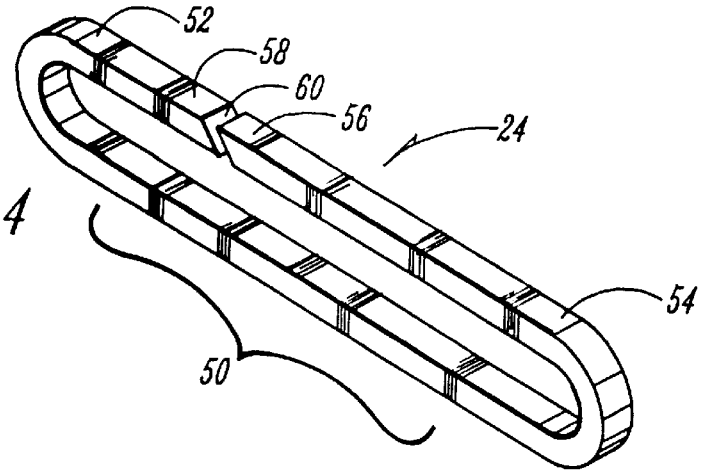
FIG. 4 is a perspective view of a loop-shaped connector of the present invention.

Referring to FIG. 3, the C-shaped hook connector 22 includes a central portion 44, a first hook end 46 and a second hook end 48. The hook ends 46, 48 each have hook tips 47, 49 respectively which are spaced apart a distance slightly greater than the thickness of the insulative board Referring to FIG. 4, the loop shaped hook connector 24 includes a central portion 50, a first hook end 52, and a second hook end 54. The hook ends 52, 54 each include hook tips 56, 58 respectively which are spaced a short distance apart to form a slot 60.

Figure 10:
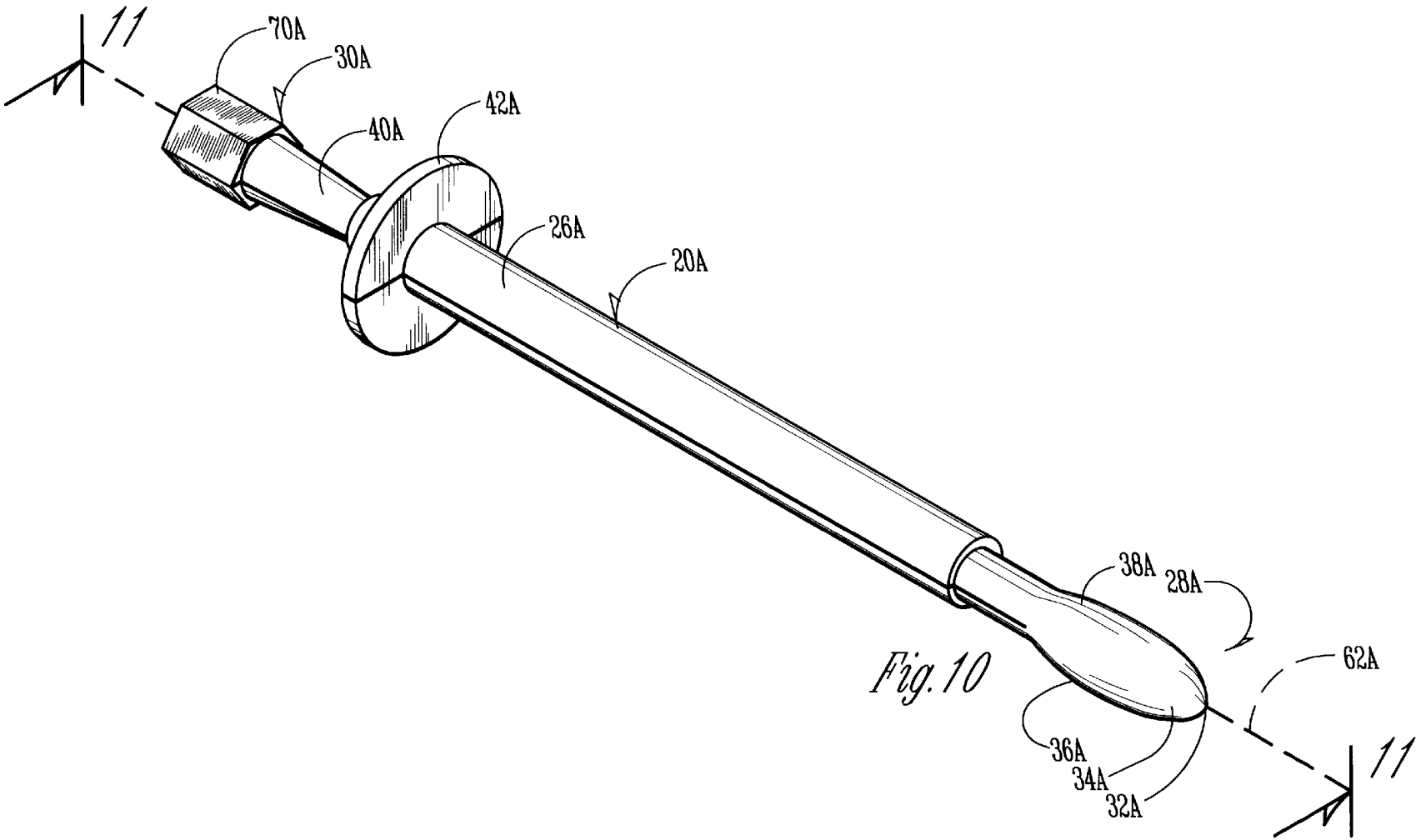
FIG. 10 is a perspective view of a second embodiment of a connector according to the present invention.
Figure 11:
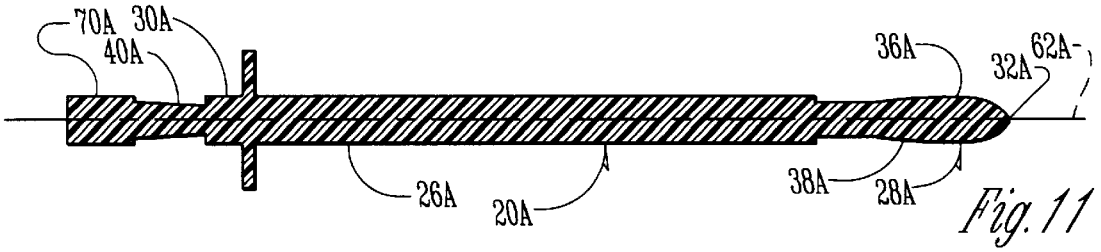
FIG. 11 is a sectional view taken along lines 11—11 of FIG. 10.
Figure 12:
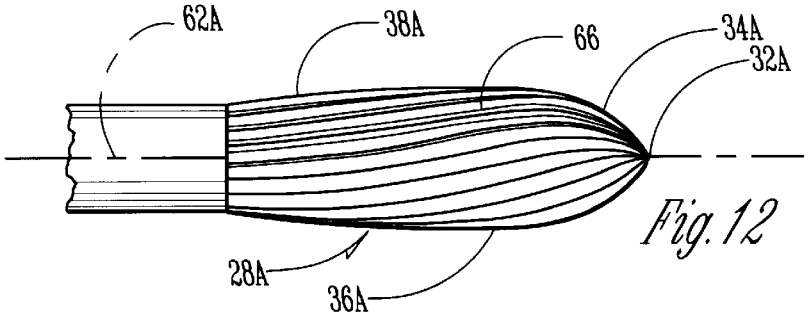
FIG. 12 is a partial side elevation view showing a rasp tip alternative for the connector of FIG. 10.
Figure 13:
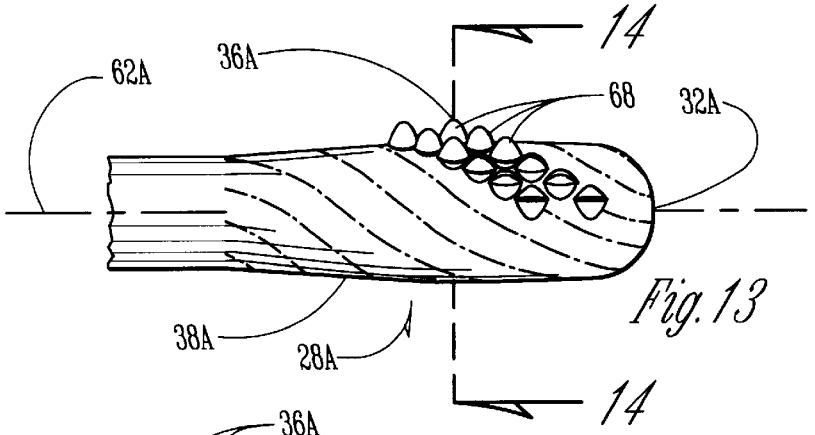
FIG. 13 is a partial elevational view showing a second rasp tip alternative for the connector of FIG. 10.
Figure 14:
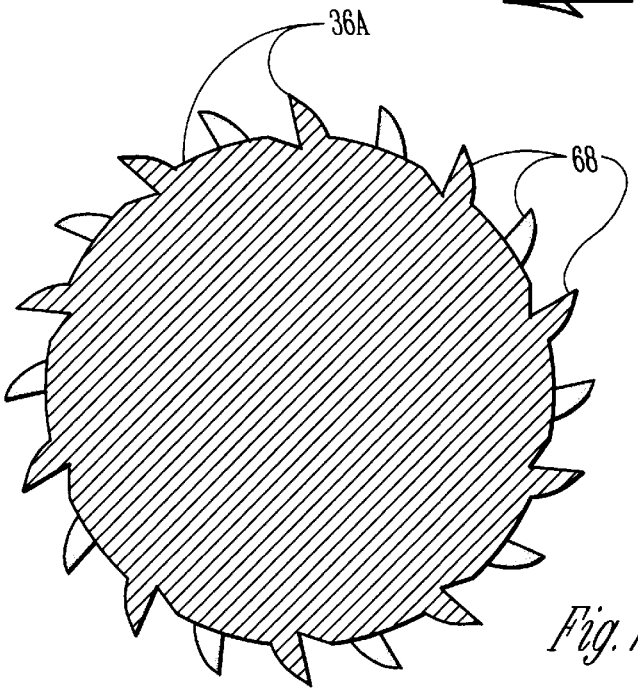
FIG. 14 is a sectional view taken along lines 14—14 of FIG. 13.

A second embodiment of a connector 20A is shown in FIGS. 10–14. The connector 20A includes a central body portion 26A, a first end portion 28A, and a second end portion 30A. The first end portion 28A includes a pointed tip 32A with an outwardly tapered surface 34A to a wide portion 36A and a varying dimension to a smaller dimension adjacent the central body portion 26A so as define a holding surface 38A. The second end portion 30A also includes a varying or tapered dimension toward the central body portion 26A to define a holding surface 40A. A flange 42A is provided between the central body portion 26A and the second end portion 30A. The connector 20A has a longitudinal axis 62A. The first end portion 28A of connector 20A may have a smooth surface, as shown in FIG. 10, or alternatively may have a rasp or drill surface 66 for boring through the insulation layer, as seen in FIG. 12. As a further alternative, the end portion 28A may have a plurality of cutting protrusions 68 which form a modified rasp surface. The second end portion 30 includes a head 70A having a geometric shape, as best seen in FIG. 10, adapted to receive a tool for rotating the connector 20A about its longitudinal axis 62A as the connector is being forced through the insulation layer, particularly with the rasp ends 66, 68 shown in FIGS. 12 and 13. As seen in FIG. 11, preferably the connector 20A is made of a one-piece construction of a moldable material, such as plastic or resin.

Figures 15, 17:
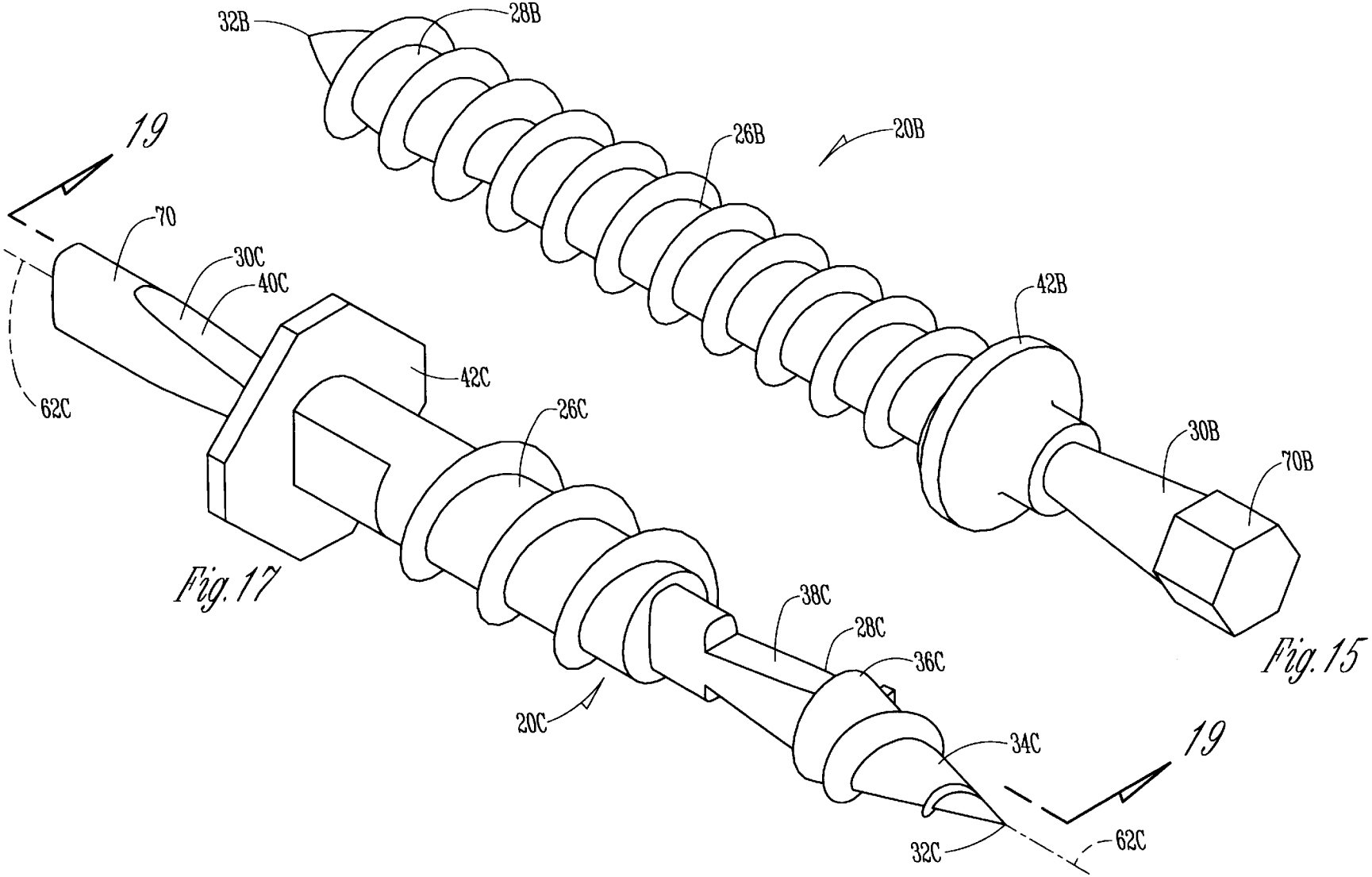
FIG. 15 is a perspective view of a third alternative embodiment of the connector according to the present invention.
FIG. 17 is a perspective view of a fourth alternative connector according to the present invention.
Figure 16:
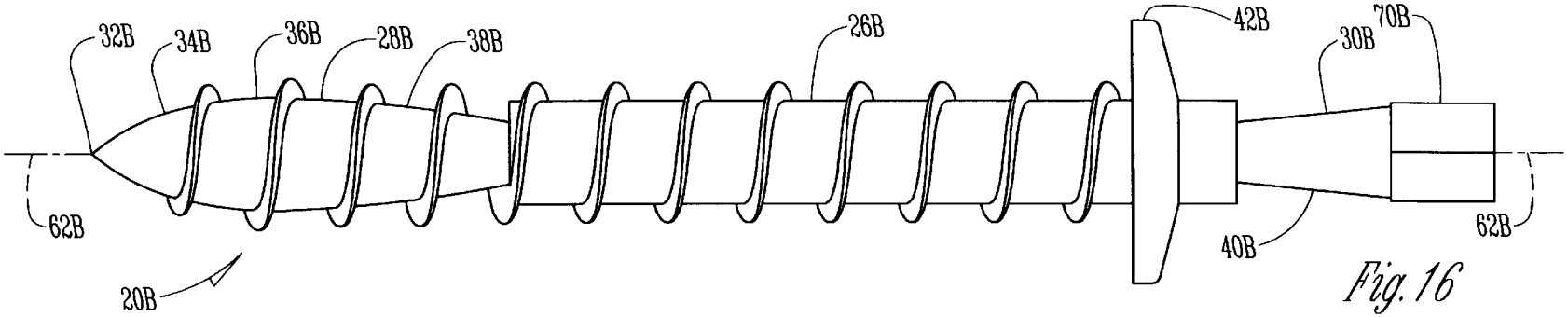
FIG. 16 is a side elevation view of the connector of FIG. 15.

A third embodiment of a connector 20B is shown in FIGS. 15 and 16. The connector 20B includes a central body portion 26B, a first end portion 28B and a second end portion 30B. The first end portion 28B includes a pointed tip 32B with an increasing diameter to a wide portion 36B and then a decreasing diameter to the central portion 26B. Thus, the varying dimension of the first end portion defines a holding surface 38B for holding the first concrete layer against movement relative to the insulation. Similarly, the second end portion 30B includes a varying dimension toward the central body portion 26B so as define a holding surface 40B to secure the second layer of concrete against movement relative to the insulation layer. An enlarged flange 42B is provided between the central body portion 26B and the second end portion 30B. The second end portion 30B also includes a geometrically shaped head 70B adapted to receive a tool, such as a wrench, for rotating the connector 20B about its longitudinal axis 62B. The connector 20B includes a helical flighting or threads 72 extending along the first end portion 28B and the central body portion 26B. Thus, upon rotation of the connector 20B about its longitudinal axis 62B, the connector is threadably screwed through the insulation layer. Preferably, the connector 20B is formed by a one-piece construction of molded plastic or resin.

Figure 18:
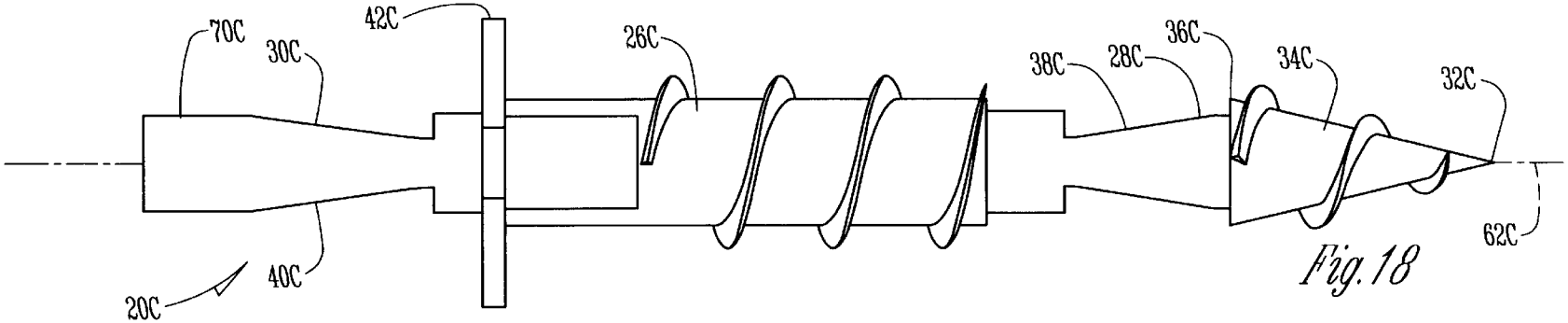
FIG. 18 is a side elevation view of the connector of FIG. 17.
Figure 19:
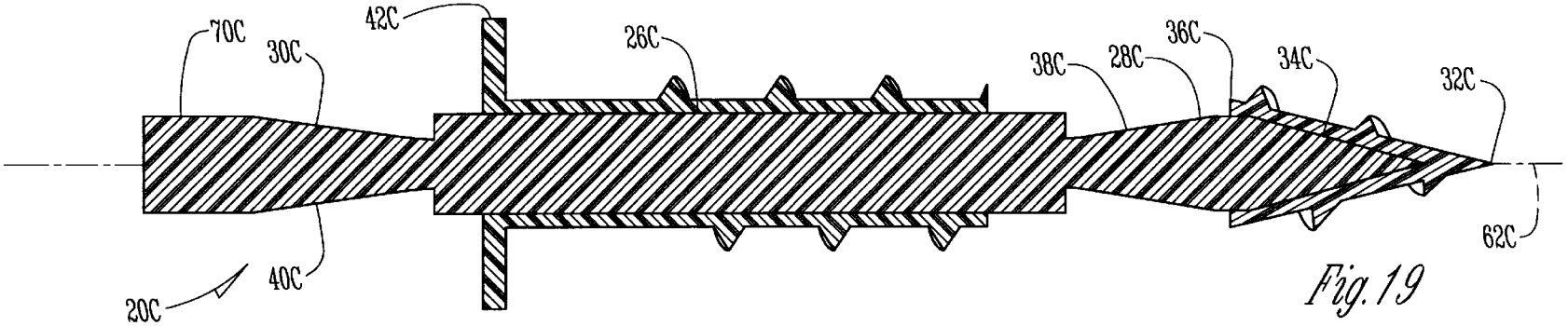
FIG. 19 is a sectional view taken along lines 19—19 of FIG. 17.

A fourth embodiment of a connector 20C is shown in FIGS. 17–19. The connector 20C includes a central body portion 26C, a first end portion 28C, and a second end portion 30C. The connector 20C includes a pointed tip 32C, with a point taper 34C extending to a wide portion 36C. A varying dimension 38C extends from the wide portion 36C to the central body portion 26C to define a holding surface 38C which holds the first layer of concrete against movement relative to the insulation layer. The second end portion 30C of the connector 20C includes a varying dimension defining a holding surface 40C for securing the second layer of concrete against movement relative to the insulation layer. The second end portion 30C includes a head 70C adapted to rotate the connector 20C about its longitudinal axis 62C. The connector 20C also includes a flange 42C between the central body portion 28C and the second end portion 30C.

As can be seen from FIGS. 17–19, the connector 20C is a multiple component construction, including a central core 74, a cap 76 and a collar 78. The cap 76 and the collar 78 include threads 80 for threadably screwing the connector 20C through the insulation layer. Preferably, the core 74 is similar to the connector 20 shown in FIGS. 2, 5 and 9. The cap 76 and collar 78 are fixed to the core 74 by a heated plastic injection.

The flighting or threads 72 on the central portion 26B of the connector 20B and the threads 80 on the central body portion 26C of the connector 20C function to drill through the insulation material and to provide a moisture seal in the insulation layer. More particularly, the threads 72 and 80 displace the insulation material as the connector 20B and 20C, respectively, are threaded through the insulation, thereby compressing the insulation material to form a seal which prevents the migration of water vapor through the insulation at the penetration point.

Figure 2:
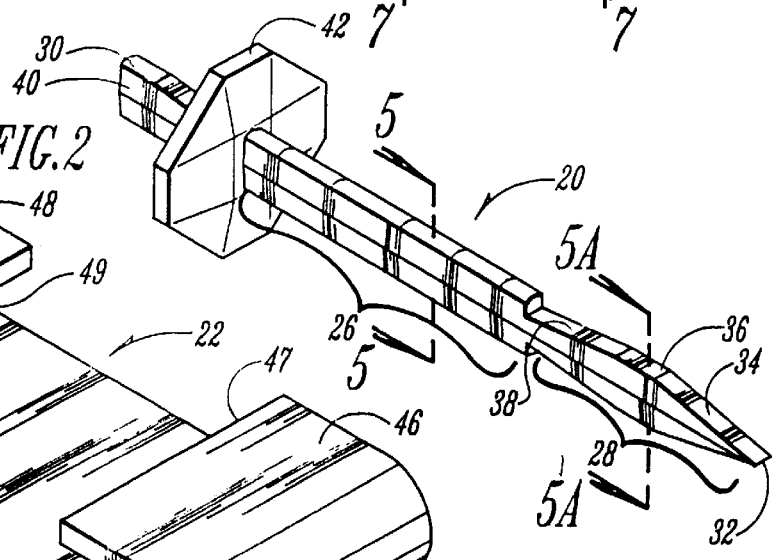
FIG. 2 is a perspective view of a first embodiment of one of the connectors of the present invention.
Figure 6:
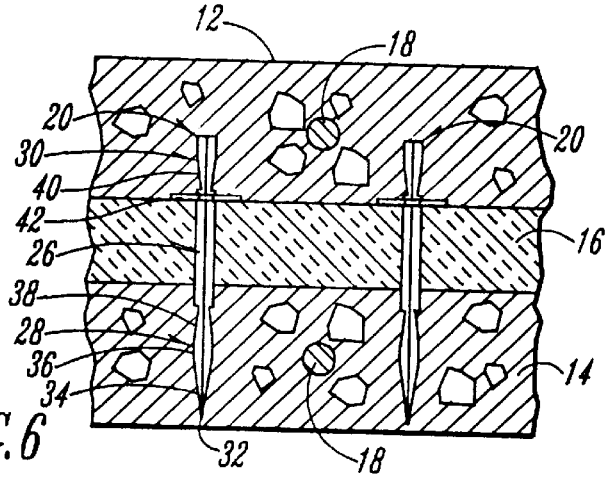
FIG. 6 is a sectional view taken along lines 6—6 of FIG. 1.
Figure 7:
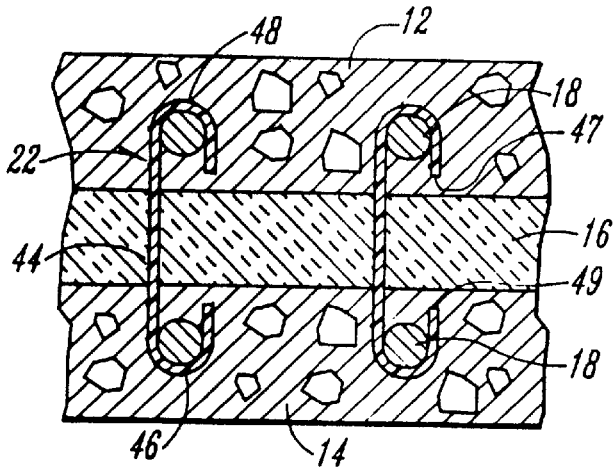
FIG. 7 is a sectional view taken along lines 7—7 of FIG. 1.
Figure 9:
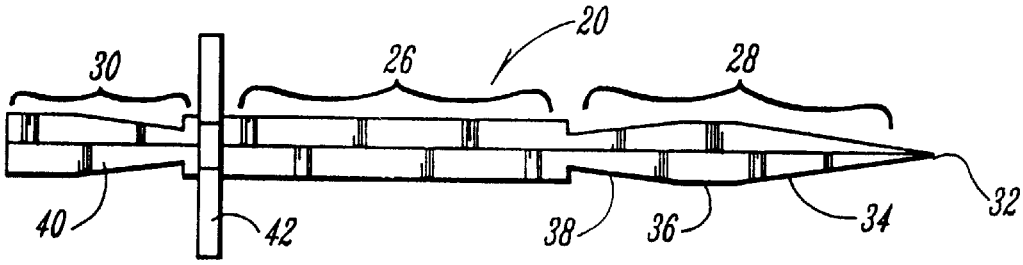
FIG. 9 is an elevational view of the connector shown in FIG. 2.

The method of construction using the connectors 20 shown in FIGS. 2 and 9 is as follows. First a form is made for one of the layers 12, 14 of concrete, and concrete is poured into that layer. Next a plurality of connectors 20 are forced through the insulation board without pre-drilling the insulation layer. With connector 20, the sharp pointed end 32 permits the connector 20 to be pushed through the softer insulation material. The fact that the wide portion 36 has approximately the same size and cross-sectional shape as the central portion 26, permits the pointed end portion 28 to form a hole in the insulation board which permits the entry of the central portion 26. When using connectors having the flange 42, the connector are inserted until the flange 42 abuts against the insulation board 16 as shown in FIG. 6. In this position, the blunt end portions 30 are protruding above the insulation board, and the pointed end portions 26 are protruding downwardly through the opposite side of board 26.

Assuming that concrete layer 14 is the first layer to be poured, the insulation board 16 is placed over the layer 14 before the concrete cures or hardens, and the pointed portions 26 of the connectors 20 are forced downwardly into the concrete layer 14 and become imbedded therein as shown in FIG. 6. Alternatively, the insulation layer 16 can be placed over the wet concrete layer 14 before the connectors are forced through. Then, the connectors 20 can be forced through the insulation layer 16 and into the uncured concrete layer 14.

Next, the concrete layer 12 is formed and poured above the insulative layer 16 so that it completely surrounds and covers the blunt end portions 30 of each of the connectors 20.

When the concrete of layers 12 and 14 cures and hardens, it holds the layers 12, 14 tightly against the insulation board 16 by virtue of the holding surfaces 38 on the connectors 20. It is possible to use the spike connectors 20 with or without the flange 42, but it is important that the end portions 26, 30 protrude outwardly beyond the opposite sides of the insulative board 16 and into the concrete layers 12, 14.

The method of constructing the composite wall using connectors 20A, 20B, and 20C is similar to the method described above with respect to connectors 20. More particularly, the connector 20A shown in FIGS. 10 and 11 can be punched through the insulation layer or can be turned through the insulation layer by rotation about its longitudinal axis 62A. When rasp tips 66 or 68 are provided on the connector 20A, rotation of the connector about its longitudinal axis allows the connector to bore through the insulation layer while minimizing the displacement of any insulation material into the concrete layer 14.

Similarly, the connectors 20B and 20C can be rotated about their longitudinal axis 62B, 62C so as to be threaded through the insulation layer without dislodging sections of insulation material into the concrete layer 14. Thus, proper consolidation of the first end portions 28B, 28C are preserved in the concrete layer 14. Also, the rotation of the connectors 20B, 20C in the concrete layer 14 assures transfer of the concrete onto the holding surface 38B, 38C, thereby enhancing the consolidation of the concrete. The threads 72 on the central body portion 26B of connector 20B, and the threads 80 on the central body portion 26C of connector 20C displace the insulation material as the connector moves therethrough, thus putting the insulation material into compression so as to form a moisture barrier seal which prevents the migration of water vapor through the insulation material at the penetration point of the connectors.

It is also possible to use the C-shaped connectors 22 during the formation of the insulated wall with any of the connectors 20, 20A, 20B and 20C. When the connectors 22 are used, they are inserted through the insulation board 16. This may be done by inserting them through pre-formed holes in the insulation board 16, or holes can be punched to permit the insertion of these C-shaped connectors 18. When the insulation board 16 is placed over the as yet uncured concrete layer 14, the hook ends 48 are hooked over the strands or cables 18 which extend through the concrete layer. Then, when the upper layer 12 is poured and the strands 18 are placed therein, the upper hook portions 48 are hooked over the cables 18 so as to secure the cables 18 in the layer 12 to the cables 18 in the concrete layer 14.

Figure 8:
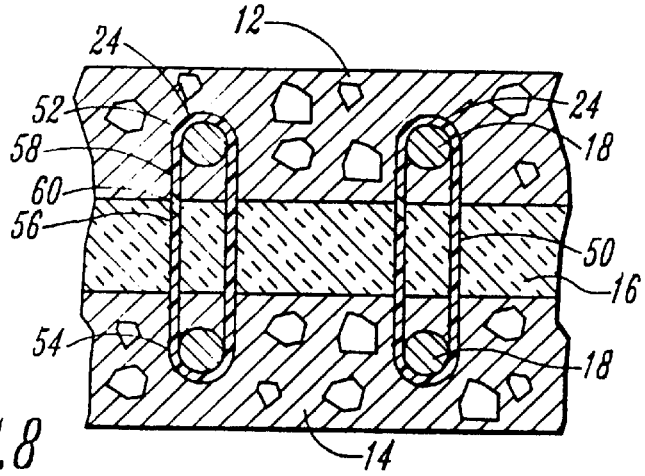
FIG. 8 is a sectional view similar to FIG. 7, but showing the loop connectors in the place of the C-shaped connectors.

FIG. 8 shows a similar construction utilizing the loop shaped connectors 24 in the place of the C-shaped connectors 22. Both the C-shaped connectors 22 and the loop shaped connectors 24 are formed of plastic fibrous material which has a high R-value. Also the loop shaped connector 24 is flexible so that the hook tips 56, 58 may be pried apart slightly so as to permit the loop to be hooked around the cables 18 as shown in FIG. 8.

Because the connectors 20—20C, 22, 24, are all made of high R material such as fiberglass or other plastic material, there is a complete thermal barrier between the two concrete layers 12, 14. This is to be contrasted with many prior art devices which utilize metal connectors capable of providing a thermal conduit between the two concrete layers. The various connectors 20—20C, 22, 24 may be used in a variety of combinations so as to minimize the cracking or bowing of the composite panels in response to temperature changes.

In the drawings and specification, there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A connector for a composite wall having first and second spaced apart concrete layers and an insulation layer sandwiched between the concrete layers, the connector comprising:

a central body portion;

first and second end portions extending oppositely from the central body portion, wherein each of the central body portion and first and second end portions are substantially flat and all have substantially the same thickness;

a pointed tip on the first end portion such that the connector can be forced through the insulation layer without pre-forming a hole in the insulation layer, with the first and second ends extending outwardly from opposite sides of the insulation layer;

a flange between the central body portion and second end portion to limit the penetration of the connector through the insulation;

the first and second end portions each having a segment of varying dimension so as to hold the first and second concrete layers, respectively, against movement away from the insulation layer; and the segment of the second end portion including a head and the varying dimension being a decreasing width toward the central body portion so as to define a holding surface with a dimension narrower than the central body portion.

2. The connector of claim 1 wherein the central body portion and first and second end portions have a one-piece construction.

3. The connector of claim 1 wherein the segment of the first end portion includes an increasing width from the tip to a wide point and a decreasing width from the wide point toward the central body portion.

4. The connector of claim 1 wherein the second end portion has a blunt terminal end.

5. The connector of claim 1 wherein the second end portion head is adapted to receive a tool for rotating the connector about a longitudinal axis.

6. A connector for a composite wall having first and second spaced apart concrete layers and an insulation layer sandwiched between the concrete layers, the connector comprising:

a central body portion;

first and second end portions extending oppositely from the central body portion, wherein each of the central body portion and first and second end portions are substantially rectangular in cross section;

a pointed tip on the first end portion such that the connector can be forced through the insulation layer without pre-forming a hole in the insulation layer, with the first and second ends extending outwardly from opposite sides of the insulation layer;

a flange between the central body portion and second end portion to limit the penetration of the connector through the insulation;

the first and second end portions each having a segment of varying dimension so as to hold the first and second concrete layers, respectively, against movement away from the insulation layer; and the segment of the second end portion including a head and the varying dimension being a decreasing width toward the central body portion so as to define a holding surface with a dimension narrower than the central body portion.

7. The connector of claim 6 being comprised of a material with a low thermal conductivity.

8. The connector of claim 6 wherein the central body portion and first and second end portions have a one-piece construction.

9. The connector of claim 6 wherein the segment of the first end portion includes an increasing width from the tip to a wide point and a decreasing width from the wide point toward the central body portion.

10. A connector for a composite wall having first and second spaced apart concrete layers and an insulation layer sandwiched between the concrete layers, the connector comprising:

a central body portion;

first and second end portions extending oppositely from the central body portion, wherein the first end portion includes threads for threaded passage through the insulation layer;

a pointed tip on the first end portion such that the connector can be forced through the insulation layer without pre-forming a hole in the insulation layer, with the first and second ends extending outwardly from opposite sides of the insulation layer;

a flange between the central body portion and second end portion to limit the penetration of the connector through the insulation;

the first and second end portions each having a segment of varying dimension so as to hold the first and second concrete layers, respectively, against movement away from the insulation layer; and the segment of the second end portion including a head and the varying dimension being a decreasing width toward the central body portion so as to define a holding surface with a dimension narrower than the central body portion.

11. The connector of claim 10 wherein the central body portion includes threads.

12. The connector of claim 11 wherein the threads of the central body portion form a moisture seal when the connector is threaded through the insulation to prevent migration of moisture through the insulation layer.

13. A connector for a composite wall having first and second spaced apart concrete layers and an insulation layer sandwiched between the concrete layers, the connector comprising:

a central body portion;

first and second end portions extending oppositely from the central body portion;

a pointed tip on the first end portion such that the connector can be forced through the insulation layer without pre-forming a hole in the insulation layer, with the first and second ends extending outwardly from opposite sides of the insulation layer wherein the tip on the first end portion includes rasps for boring through the insulation.

* * * * *